United States Patent [19]

Frost, Jr.

[11] 4,108,613

[45] Aug. 22, 1978

[54] POUR POINT DEPRESSANTS

[75] Inventor: Kenneth A. Frost, Jr., San Rafael, Calif.

[73] Assignee: Chevron Research Company, San Francisco, Calif.

[21] Appl. No.: 837,798

[22] Filed: Sep. 29, 1977

[51] Int. Cl.[2] ..... C10L 1/22

[52] U.S. Cl. ..... 44/62; 44/72

[58] Field of Search ..... 260/584 B, 584 R, 584 C; 44/62

[56] References Cited

U.S. PATENT DOCUMENTS

| | | | |
|---|---|---|---|
| 2,856,363 | 10/1958 | Brennan | 260/584 B |
| 3,092,475 | 6/1963 | Coles et al. | 44/72 |
| 3,317,609 | 5/1967 | Lesesne | 260/584 B |
| 3,598,552 | 8/1971 | Cohen et al. | 44/62 |
| 3,638,349 | 2/1972 | Wisotsky et al. | 44/62 |
| 3,661,541 | 5/1972 | Hollyday, Jr. | 44/62 |
| 3,792,983 | 2/1974 | Tunkel et al. | 44/62 |
| 4,049,557 | 9/1977 | Wixon | 260/584 B |

*Primary Examiner*—Winston A. Douglas
*Assistant Examiner*—Mrs. Y. Harris-Smith
*Attorney, Agent, or Firm*—D. A. Newell; C. J. Tonkin; J. J. DeYoung

[57] ABSTRACT

Pour point depressants for hydrocarbonaceous fuels and oils are formed from a mixture of (1) the reaction product of an epoxidized alpha-olefin with a nitrogen-containing compound selected from ammonia, an amine, a polyamine or a hydroxyamine, and (2) an ethylene-olefin copolymer having a molecular weight in the range 1000 to 100,000.

11 Claims, No Drawings

POUR POINT DEPRESSANTS

FIELD OF THE INVENTION

This invention relates to new materials which are useful as pour point depressants for hydrocarbonaceous fuels and oils.

BACKGROUND OF THE INVENTION

When using liquid hydrocarbons as lubricating oils or fuels, it is necessary that the hydrocarbon fluids flow readily at low temperatures, especially at temperatures below the freezing point of water (0° C). The flow of these fluids, particularly those with high wax content, is very sensitive to low temperatures. At low temperature when the wax crystallizes, the fluid sets up as a waxy material and does not pour. The pour point depressant additives do not reduce the amount of wax which crystallizes from the fluids, but rather modify their surface by absorption or co-crystallization. This reduces the fluid occlusion by the crystals and changes the wax crystal structure, thus permitting the fluid to flow.

Major types of materials that have found wide acceptance as pour point depressants are naphthylene alkylated with chlorinated waxes and homo- or copolymers of hydrocarbon olefins, methacrylates, vinyl esters and alkyl styrene.

Pour point depressants consisting of succinamic acid or salts preferably in combination with an ethylene-olefin copolymer are described in U.S. Pat. No. 3,544,467.

SUMMARY OF THE INVENTION

A material useful as a pour point depressant for hydrocarbonaceous fuels and oils comprising a mixture of:

(1) the reaction product of an epoxidized alpha-olefin containing from 14 to 30 carbon atoms, and a nitrogen-containing compound selected from ammonia, an amine, $R_2NH$, wherein R contains from 6 to 30 carbon atoms, a polyamine, $H_2N—(CH_2CH_2NH)_x—CH_2CH_2—NH_2$ wherein $x$ is 0 to 4, and a hydroxyalkylamine, $HO—(CH_2)_y—NH_2$, wherein $y$ is 1 to 5; and (2) an ethylene-olefin copolymer having a molecular weight in the range 1000 to 100,000.

DETAILED DESCRIPTION OF THE INVENTION

The novel additives described above are used to lower the pour point of hydrocarbonaceous fuels and oils, particularly diesel fuels. The additive is formed from a mixture of (1) the reaction product of an epoxidized alpha-olefin and an amine, and (2) an ethylene-olefin copolymer.

The reaction of the epoxidized alpha-olefin and the amine compound is fully described in my copending application Ser. No. 811,236, filed June 29, 1977, the entire disclosure of which is incorporated herein by reference. An epoxidized alpha-olefin containing from 14 to 30 carbon atoms is reacted with a nitrogen-containing compound as described therein. This reaction is carried out at a temperature from 25° to 250° C, and preferably from 50° to 175° C. The reaction is usually carried out at atmospheric pressure, although higher or lower pressures may be used, if desired.

The molar ratio of the reactants is preferably 1–7 mols of epoxidized alpha-olefin to 1 mol of nitrogen-containing compound, and most preferably from 1 to 5 mols epoxidized alpha-olefin to 1 mol nitrogen-containing compound.

The epoxidized alpha-olefin is prepared by treating an olefin having from 14 to 30 carbon atoms with an epoxidizing agent, such as 40% peracetic acid, perbenzoic acid, m-chloro perbenzoic acid and performic acid. The alpha-olefins are available from many sources, including those made by the Ziegler process and wax cracking.

The amine of the formula $R_2NH$ can be any oil-soluble amine containing from 6 to 30 carbon atoms in each R group. Preferably each R group is aliphatic, and most preferably each R group is derived from tallow.

The polyamines useful in preparing the pour point depressant of this invention are ethylene amine and the well-known polyethylene amines, specifically ethylene diamine, diethylene triamine, triethylene tetraamine, tetraethylene pentamine and pentaethylene hexamine. These compounds are usually prepared by the reaction of an alkylene chloride with ammonia. This reaction yields a somewhat complex mixture of alkylene amines, including some cyclic condensation products. These mixtures are also useful in the process of this invention and are included within the scope of the term "polyamine".

The hydroxy amines used to prepare the compounds of this invention are alkylene amines having 1 hydroxy substituent. The preferred hydroxyalkylamine of this invention is ethanol amine.

Ammonia can be used to prepare nitrogen-containing compounds of this invention.

The ethylene-olefin copolymers of the present invention are from 1000 in to 100,000 molecular weight, preferably from about 1500 to 20,000 molecular weight. The mol ratio of ethylene to its comonomer is from about 6–12:1.

The polymers employed in this invention should have polyethylene segments in the polymer approximating the chain length of the wax. That is, the polyethylene segments should have from about 6 to 12 monomers on the average.

The major function of the other monomer, therefore, is to act as a divider between the polyethylene segments. For this reason, various monomers may be used which can be conveniently copolymerized with the ethylene. These olefins include hydrocarbon terminal olefins of from about 3 to 12 carbon atoms, more usually of from about 3 to 6 carbon atoms, and various heteroatom-containing addition polymerizable terminal olefins such as the acrylates, methacrylates, vinyl ethers, vinyl ketones, vinyl esters, vinyl chlorides, etc.

The hydrocarbon olefins which find use will have the following formula:

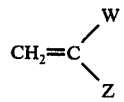

wherein W is hydrogen or methyl and Z is hydrocarbon of from 1 to 10 carbon atoms, more usually alkyl of from 1 to 4 carbon atoms Z is free of aliphatic unsaturation.

For the most part, the hetercatom-containing olefins will have the following formula:

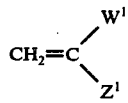

wherein W' is hydrogen, alkyl of from 1 to 3 carbon atoms or Z', and Z' is hydrocarbyloxy, acyloxy ($QCO_2$—), hydrocarbyl carbonyl, and hydrocarboxycarbonyl

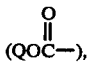

wherein Q is a saturated aliphatic hydrocarbyl group, Z' is free of aliphatic unsaturation, and has from 1 to 22 carbon atoms.

The preferred Z' is acyloxy and hydrocarbyloxycarbonyl. The heteroatom-containing monomer will generally be of from 4 to 24 carbon atoms, more usually of from 4 to 20 carbon atoms, have from 1 to 2 oxygen heteroatoms, and have only one site of olefinic unsaturation as its only aliphatic unsaturation.

The method of preparation of the polymer is not critical to this invention. Any convenient method for obtaining polymers of the desired molecular weight may be used. In preparing the hydrocarbon copolymers, usually nonstereospecific catalysts will be employed. Illustrative of such catalysts are triethylaluminum with vanadium oxychloride or titanium tetrachloride. These catalysts are in the category known as "Ziegler-type" catalysts. Alternatively, free radical high-pressure polymerizations may also be used.

Many suitable ethylene-olefin copolymers are commercially available. Particularly preferred for use in the present invention are the ethylene vinylacetate copolymers, for example WD-22 made by the Appollo Chemical Co., and the ethyleneacrylate copolymer AMOCO A-543 made by Amoco.

The pour point depressants of this invention may be used with a variety of hydrocarbon fuels which require the lowering of their pour points. The compositions of this invention are particularly useful with mid-range distillate fuels boiling in the range 200° to 700° F.

Both naturally derived and synthetic hydrocarbon fuels may be used in conjunction with the pour point depressant compositions of this invention. Naturally derived oils include naphthenic, paraffinic, asphaltic or mixed base oils which may be waxy or partially dewaxed. Synthetic oils may be derived by polymerization of olefins, generally in the range from $C_6$–$C_{12}$.

The pour point depressants of this invention are particularly useful with diesel fuels obtained from cracked light cycle oil. Cracked light cycle oils generally have boiling ranges in the range of 300° F to 700° F (ASTM D-158-54).

Usually at least 10 parts per million or more of the point point depressant composition will be used, and preferably 25 to 1500 parts per million Generally the amount of pour point depressant used will be less than about 2 weight percent, and generally less than about 1 weight percent of the hydrocarbon fluid. However, up to 10,000 parts per million or more of the point point depressants may be necessary for certain types of fuels.

The ratio of: (1) the reaction product of the epoxidized alpha-olefin and the amine to (2) the ethylene-olefin copolymer may range from 20:1 to 1:20, but preferably is in the range 10:1 to 1:2.

The pour point depressant compositions may be used in the presence of various other additives which are common to compounded fuels. In addition to pour point depressants, there may be present rust inhibitors, oiliness agents, dyes, detergents, etc. Usually these other additives will be present in amounts of from about 10 parts per million to 10 weight percent.

EXAMPLES

The following examples are offered by way of illustration of the invention.

EXAMPLE 1

To 40 g (0.079 mol) of ditallow amine at 175° C is added dropwise 20 g (0.079 mol) of a $C_{15}$–$C_{20}$ alpha-olefin oxide. The reaction mixture is stirred for 6 hours, cooled, diluted with hexane and then washed 3 times with 150 ml water. The mixture is dried and filtered and then cooled over ice to give a solid. The product is then warmed and allowed to cool to room temperature to get large crystals. Solvent is removed from the product to yield 39.5 g having a molecular weight of 614 and containing 2.00% nitrogen.

EXAMPLE 2

To a 200-ml flask with stirring under nitrogen is added 50.8 g (0.20 mol) of a $C_{15}$–$C_{20}$ alpha-olefin oxide and 4.0 g (0.066 mol) of ethylene diamine. The reaction mixture is heated to 150° C for 2½ hours to yield a product having a molecular weight of 842 and containing 5.53% nitrogen.

EXAMPLE 3

The pour point depressant effect of the additives of this invention was determined for a test fuel according to ASTM D-97-57. The test fuel was a Richmond refinery No. 2 diesel. The results of these tests are illustrated in Table I.

TABLE I

| Pour Point Improver | Pour Point, ° F |
|---|---|
| None | 10 |
| 100 ppm Amoco A-543[1] | 10 |
| 400 ppm product of Ex. 1 & 100 ppm Amoco A-543 | −20 |
| 500 ppm product of Ex. 1 | 5 |
| 1000 ppm product of Ex. 1 | <−40[2] |

[1]Amoco A-543 is an ethylene-acrylate copolymer
[2]The symbol < means "less than".

EXAMPLE 4

The low Cold Filter Plugging Point (CFPP) test measures the ability of a fuel to flow through a micronic filter element below its cloud point. The test has been officially accepted as a specification method relating to low-temperature operability for critical European auto diesel equipment. The test procedure and apparatus are described in DIN-51428 (the West German equivalent to the United States ASTM). In brief, the test consists of passing a standard volume of sample fuel through a 350 U.S. Standard Wire Mesh Filter at successively decreasing temperatures. The presence of precipitated fuel wax will cause the flow rate to decrease, and eventually complete plugging of the filter will occur. The temperature at which flow finally ceases is the Cold Filter Plugging Point, and is reported to the nearest 2° F.

The samples contain various amounts of the pour point depressants of this invention. The test fuel is a Pernis refinery production fuel for auto diesel and No. 2 heating. The sample fuels are tested and reported in Table II below.

TABLE II

| Pour Point Depressant | CFPP, °F |
|---|---|
| None | 24 |
| 240 ppm product of Ex. 2 | 24 |
| 60 ppm WD-22[1] | 20 |
| 240 ppm product of Ex. 2 & 60 ppm WD-22[1] | 6 |

[1]WD-22 is an ethylene-vinylacetate copolymer

As will be evident to those skilled in the art, various modifications of this invention can be made in light of the foregoing disclosure and discussion without departing from the spirit or scope of the disclosure or from the scope of the following claims.

What is claimed is:

1. A material useful as a pour point depressant for hydrocarbonaceous fuels and oils comprising a mixture of:

(1) the reaction product of an epoxidized alpha-olefin containing from 14 to 30 carbon atoms and a nitrogen-containing compound selected from ammonia, an amine, a polyamine, or a hydroxyamine; and (2) an ethylene-olefin copolymer having a molecular weight in the range 1000 to 100,000.

2. The material according to claim 1 wherein said nitrogen-containing compound is selected from: ammonia, an amine, $R_2NH$, wherein R contains from 6 to 30 carbon atoms; a polyamine, $H_2N—(CH_2CH_2NH)_x—CH_2CH_2—NH_2$, wherein $x$ is 0 to 4; and a hydroxyalkylamine, $HO—(CH_2)_y—NH_2$, wherein $y$ is 1 to 5.

3. The material according to claim 1 wherein the epoxidized alpha-olefin contains 14 to 20 carbon atoms and said ethylene-olefin copolymer has a molecular weight in the range 1500 to 20,000.

4. The material according to claim 3 wherein the nitrogen-containing compound is an amine wherein R is an alkyl or alkenyl group containing from 16 to 18 carbon atoms.

5. The material according to claim 3 wherein said ethylene-olefin copolymer is an ethylene vinylacetate copolymer.

6. The material according to claim 4 wherein the nitrogen-containing compound is ditallow amine, ethylene diamine, diethylenetriamine or enthanolamine.

7. The material according to claim 3 wherein the ratio of said reaction product to said copolymer is in the range 20:1 to 1:20.

8. The material of claim 3 wherein the ratio of said reaction product to said copolymer is in the range 10:1 to 1:2.

9. A fuel composition comprising a distillate fuel and a pour-point-depressant amount of the material of claim 1.

10. A method for lowering the pour points of fuels which comprises adding a pour-point-depressant amount of a material according to claim 1.

11. A material useful as a pour point depressant for hydrocarbonaceous fuels and oils consisting essentially of a mixture of:

(1) the reaction product of an epoxidized alpha-olefin containing 14 to 20 carbon atoms, and a nitrogen-containing compound selected from: ammonia, an amine, $R_2NH$, wherein R contains from 6 to 30 carbon atoms; a polyamine, $H_2N—CH_2CH_2N)_x—CH_2CH_2—NH_2$, wherein X is 0 to 4; and a hydroxyalkylamine, $HO—(CH_2)_y—NH_2$, wherein $y$ is 1 to 5; and (2) an ethylene vinylacetate or ethylene acrylate copolymer having a molecular weight in the range of 1500 to 20,000.

* * * * *